United States Patent [19]

Muller et al.

[11] Patent Number: 4,832,341

[45] Date of Patent: May 23, 1989

[54] HIGH SECURITY INSTANT LOTTERY USING BAR CODES

[75] Inventors: Richard W. Muller, Chicago, Ill.; Kenneth R. Rusnak, Irving, Tex.

[73] Assignee: UPC Games, Inc., Chicago, Ill.

[21] Appl. No.: 898,531

[22] Filed: Aug. 21, 1986

[51] Int. Cl.[4] ..... A63F 7/00

[52] U.S. Cl. ..... 273/139; 273/138 A

[58] Field of Search ..... 273/1 E, 85 G, 269, 273/138 A, 139, DIG. 28; 364/410–412

[56] References Cited

U.S. PATENT DOCUMENTS

| | | | |
|---|---|---|---|
| 4,373,726 | 2/1983 | Churchill et al. | 273/139 |
| 4,494,197 | 1/1985 | Troy et al. | 364/412 |
| 4,669,729 | 6/1987 | Solitt et al. | 273/139 |
| 4,677,553 | 6/1987 | Roberts et al. | 273/269 |
| 4,703,933 | 11/1987 | Cahill et al. | 273/139 |

*Primary Examiner*—Leo P. Picard

*Attorney, Agent, or Firm*—Leydig, Voit & Mayer

[57] ABSTRACT

An improved instant lottery game is provided in which lottery numbers are represented on the respective lottery tickets in their corresponding UPC bar code form. A master program provides a list of randomly generated lottery numbers from which a list of winning numbers is randomly selected. The list of lottery numbers is divided into separate batches which are used by dispensing units to sequentially and instantaneously print out, on proper external stimulation, the random lottery numbers in their UPC bar code form on lottery labels at the site of the game. The lottery labels are adapted to be firmly postioned onto a designatd space on pre-printed lottery ticket blanks, in order to constitute valid tickets. When a ticket is presented for appraisal at the reader end, a conventional bar code scanner transposes the bar code on the ticket to the corresponding lottery number, which is then automatically compared to the list of winning numbers to determine if it represents a winner and external indication of the winning or losing status of the presented lottery ticket is given. The improved system provides a flexible instant lottery which is easy to operate and provides reasonable control over game parameters like the odds of winning while maintaining a high level of security.

11 Claims, 4 Drawing Sheets

HIGH SECURITY INSTANT LOTTERY USING BAR CODES

BACKGROUND OF THE INVENTION

This invention generally relates to lottery based games and contests. In particular it relates to an instant lottery game wherein a new technique is used for the representation and identification of the lottery numbers on the lottery tickets.

A wide spectrum of lotteries and similar contests exists in which participants are eligible to win prizes awarded at random on the basis of predetermined odds of winning. In conventional lottery games the participant either purchases, or in the case of promotional lotteries is given a lottery ticket which has a lottery number inscribed on it. The lottery number on each ticket is unique and serves to distinguish it from every other lottery ticket in the same lottery game. At a later date, a winning number is determined by a random chance selection from a set of numbers which matches exactly the set of lottery numbers in distribution. The winning number may also be determined in other manners as long as it is insured that accurate prediction of the winning number is highly improbable. In such conventional lotteries, the winning number is non-existent until the moment it is selected randomly or determined according to other criteria.

In these lottery games security is provided by generating the lottery numbers under computer control. Every lottery ticket in a given lottery game has a serial number associated with it which is printed on each ticket to identify the game, ticket lot and the individual ticket itself. The lottery number for a given ticket is generated by using a complex computer algorithm which provides a unique relationship between the serial number and the lottery number for a given ticket. Whenever a winning lottery ticket is presented for redemption, a computer can be used to reverse the computer algorithm used to generate the lottery number so that the interrelationship between the serial number and the lottery number of the presented ticket may be tested prior to payment of the prize.

In the case of instant lotteries, the winning lottery number is known before the ticket is sold, so that a participant can know within a short span of time after his purchase whether he has won or not. In such instant lotteries, the operator of the lottery game either selects or determines on some basis the winning lottery numbers or related indicia which are made known to participants prior to their purchase of tickets. However, the lottery number printed on the ticket is concealed, so that the purchaser may ascertain the lottery number only after the purchase has been consumated. The purchaser then exposes the concealed lottery number to view and this exposed lottery number is compared against a list of winning numbers in order to determine if a match exists entitling the ticket holder to a prize.

In such cases of instant lotteries wherein the winning numbers are known to the public when the ticket is purchased, extensive measures have to be taken in order to insure security. Some form of concealment needs to be provided for the individual lottery number imprinted on each ticket. Generally, this takes the form of an opaque covering such as paper that can be torn off to reveal the number, or a removable coating or metal foil that covers the number. Special printing inks, such as those that change under applied heat or special agents may also be used. This concealment feature of the ticket has to be augmented with external means which permit quick and easy exposure of the lottery number so that immediate comparision can be made between the ticket lottery number and the posted listing of winning numbers. In addition, the process which transforms the lottery number from its concealed state to an openly intelligible state must necessarily be irreversable so that the end user is unable to restore the ticket to its original condition without outward signs of alteration in order to preclude reuse or resale of a ticket. Various techniques for concealment or disguise of lottery numbers for use in instant lottery games are known in the art; all of them inherently require elaborate procedures in the design, printing and especially the concealment of the lottery number and constitute a signficant portion of the overall cost of the lottery ticket.

A general problem encountered with conventional instant lottery games is the high probability of fraud subsequent to purchase of tickets. In instant lotteries, winning tickets may be presented for payment concurrent with the continuing sale of additional lottery tickets for the same lottery game. Since instantaneous accounting for both sold and unsold tickets in the same lottery game is not possible, if a counterfeit ticket is presented for payment it becomes virtually impossible to ascertain whether or not the presented ticket was purchased upon valid sale by an authorized selling agent. The possibility that the authentic ticket bearing the same winning lottery number may be unsold or in the legitimate possession of another participant cannot be ruled out.

Another problem with instant lottery tickets is that, although the game number and serial number on a ticket are not permitted to be the same, there does exist a simple relationship between the serial number and the game number and it is possible for a person to determine the correlation between the serial number and the game number. This causes special concern regarding system security for an instant lottery game because the serial number is generally used to record ticket allocations to the various sales agents handling a particular lottery game. Thus, somebody possessing knowledge of the ticket distribution pattern may be able to locate the sales agent possessing the winning tickets if he is able to decipher the simple correlation between the serial numbers and the associated winning numbers, thereby raising the possibility of fraud on the lottery game operator and the public in collusion with the sales agent. Further, the participants themselves may be able to determine the fixed relationship between the unconcealed serial numbers and concealed lottery numbers after the purchase of several tickets and use this knowledge to either counterfeit a lottery ticket to include the winning lottery number or possibly to avoid further purchase of tickets which are not potential winners.

A variety of methods for printing lottery tickets, particularly those for instant lotteries, are conventionally known. Typically, a number of manual steps are involved in the printing procedure which increases the probability that someone involved with the process may be able to identify the ultimate destination of sale including the distribution pattern of winning tickets and increases the possibility of misuse and fraud.

An approach towards increasing the security for instant lottery tickets against counterfeiting and fraudulant alteration is disclosed in U.S. Pat. No. 4,191,376 issued to Goldman et al., where the lottery number is determined by a computer and is interrelated with the serial number by a highly complex security algorithm. The serial number and the lottery number are printed on the tickets by means of computer controlled high speed printers followed by the coloring of the lottery number to hide it from view; the computer process is used to insure that no lottery numbers occur in duplicate or are entirely omitted from a completed batch of game tickets.

Although the above system provides increased security for the lottery game, it still requires an elaborate technique, such as the lamination of a foil coating by the application of heat and pressure, for concealing the lottery numbers after they have been printed on the lottery tickets. Such a technique must provide for easy uncovering of the opaque coating from the lottery number and the uncovering process must also be ireversible.

Another major problem with conventional instant lottery games is that, for a given lottery game, once a complete set of lottery tickets with associated lottery numbers on them have been printed on the basis of predefined odds of winning, no changes in the overall odds of winning can be accommodated without drastic measures such as reprinting a new set of lottery tickets. This constitutes a serious restriction to the operator of the lottery game particularly if the lottery constitutes a part of sales promotion schemes associated with consumer oriented business such as a department store or a grocery store. For example, if a lottery game is being used as a promotional scheme by say, a department store, it might be desired that the odds of winning be significantly increased on particular days when a sale is in progress in order to attract increasing number of consumers for the duration of the sale. It becomes extremely difficult to handle such changes with the use of conventional instant lottery game systems.

Accordingly, there exists a need for a flexible instant lottery game system which is easier to operate and control, which does not require elaborate printing techniques for the lottery tickets, which provides reasonable control over the odds of winning and which also provides a high level of security against fraud and misuse.

SUMMARY OF THE INVENTION

An object of this invention is to provide a new and improved instant lottery game system.

Another object is to provide a new and improved instant lottery game which has a unique method of representation of lottery numbers on the lottery tickets.

A further object is to provide such a new and improved instant lottery system the lottery tickets for which are easily and inexpensively manufactured and conveniently dispensed at desired locations.

A related object is to provide such an improved instant lottery system which has a high level of security against fraudulent misuse, alteration and counterfeiting.

A further object is to provide such an instant lottery system, the lottery tickets for which may be analyzed automatically in order to determine winning as well as loosing lottery tickets.

Yet another object of this invention is to provide an improved instant lottery system of the above type in which the odds of winning may be changed conveniently.

The above objects are achieved, according to the system of this invention by providing an instant lottery game system in which the operation of the game system including the generation of lottery numbers, reading of lottery numbers on presented game tickets and comparison of these numbers with winning numbers to determine true winners is performed by computerized means. A master computer program is used to generate the lottery numbers which are then placed on the lottery ticket in the form of conventional UPC bar codes. The master program also generates a set of randomly picked winning numbers which is programmed into the inhouse computer at the establishments where the lottery game is to be played. When a lottery ticket is presented by a game participant, the associated lottery number is read by a conventional bar code laser scanner and fed to the inhouse computer which compares the scanned number with its pre-programmed set of winning numbers, determines if the presented lottery ticket represents a winning number and provides external indication of the winning or losing status of the ticket.

A high level of security is provided because the identity of the winning numbers is accessible only to an extremely restricted group of people associated with the master program, thereby reducing the chances of fraud. In fact, the set of winning numbers may be unknown to anyone as it may be generated and distributed without need for disclosure, making it virtually impossible for the winning numbers to be accessed. Alteration of lottery tickets is made extremely difficult as it may require the deciphering of an existing bar coded number and subsequent printing of the bar code for a fraudulent winning number. The illustrious system is extremely convenient to operate because most of the hardware requirements exist in establishments where this invention may be applied. Further, instant and automatic feedback of information indicating whether or not a presented lottery ticket is a winner is provided. Additional features of this invention provide for convenient control of winning odds, game deadlines, etc., by simple software changes to the game system.

BRIEF DESCRIPTION OF THE DRAWINGS

For the purpose of facilitating an understanding of the invention, the accompanying drawings illustrate certain preferred embodiments. The above and other objects of this invention as well as the features thereof will become more apparent from the following description when taken in conjunction with the accompanying drawings in which.

DESCRIPTION OF PREFERRED EMBODIMENTS

Although the invention has been described in connection with certain embodiments, it will be understood that there is no intention to limit the invention to the embodiments shown, and various changes and modifications can be made therein without departing from the spirit and scope of the invention, and it is intended that all such changes and modifications be covered as fall within the scope of the appended claims.

Figure 1:
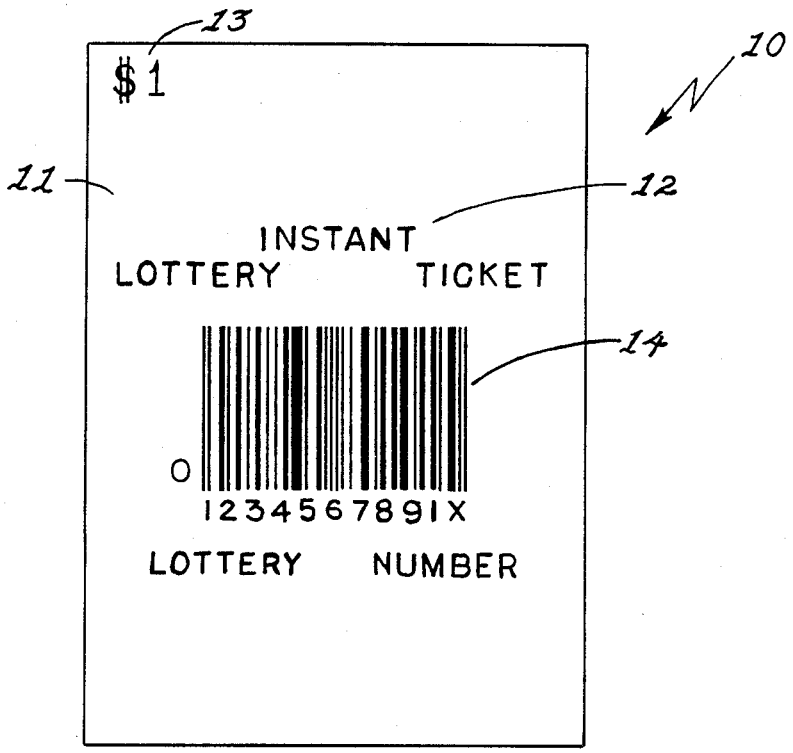
FIG. 1 is a frontal view of the face of an instant lottery ticket according to one embodiment of the present invention showing the representation of the lottery number.

Referring now to FIG. 1, there is shown a conventional instant lottery ticket 10 adapted according to one embodiment of this invention. The ticket has a ticket face 11 with the central area of the ticket face generally having game playing instructions, as well as other information normally associated with such lottery games, printed on it. Such information 12 may include the date of validity of the ticket, redemption procedures for winning tickets, identity of the game operator or other such related information. The purchase price 13 of the ticket itself may also be indicated on the face of the ticket.

A lottery number 14 is presented on the face 11 of the ticket 10. Conventionally the lottery number comprises a plurality of digits represented in the form of numeric or alphabetic characters or other indicia such as letters, pictures or symbols. According to a unique feature of this invention, the lottery number 14 is represented on the face 11 of the ticket 10 in the form of a conventional UPC bar code, which allows the number to be automatically read by conventional bar code scanners commonly available at the site of the lottery game. The lottery number itself typically comprises 12 numeric digits. The digits that originally comprise the lottery number (shown as 01234567891X) may also be printed below the bar code representing the lottery number.

FIG. *2a* shows a preferred embodiment of an instant lottery ticket according to this invention. As shown, the lottery number is not printed on the lottery ticket itself. Instead, an area is designated on the central portion of the face of the lottery ticket onto which a separately available label bearing the lottery number may be positioned.

FIG. *2b* shows such a label 21 which has the lottery number printed in bar code form 22 on its face. The label 21 has a pressure sensitive adhesive coating on its rear portion that permits the label to be conveniently positioned onto the designated label area on the instant lottery ticket. In this embodiment the lottery tickets are preprinted in the form of ticket blanks which have all required information instructions as well as other general instructions printed on them and have the designated area 24 for placement of the lottery number label. This feature permits the use of a variety of preprinted ticket blanks as lottery tickets by placing valid lottery labels on them. In order to have a valid lottery ticket, the participant in the game picks up one of the instant lottery ticket blanks, purchases the label bearing the lottery number in bar code form and then places the label onto the ticket blank.

According to a feature of this invention, the labels bearing the lottery numbers are not preprinted but are actually printed at the time of the purchase by dispensing units positioned at the establishment where the lottery game is in progress. The lottery numbers themselves are originally generated by a master computer program in the form of a set of randomly generated numbers. These lottery numbers are then transferred in the form of a data base to the dispensing unit which is capable of sequentially printing out the lottery numbers stored within its data base onto the pressure sensitive labels in the form of a UPC bar code which corresponds to the lottery number being printed.

Figure 3:
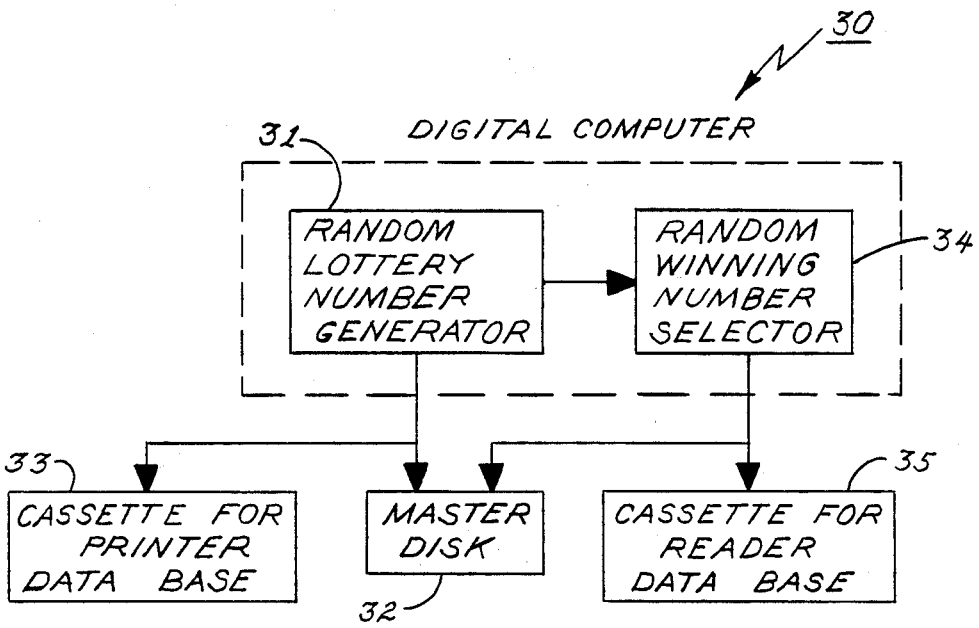
FIG. 3 is a simplified block diagram representation of the lottery number generation end of the instant lottery game according to this invention.

Turning now to FIG. 3, there is shown a simplified block diagram representation of the lottery number generating section of the instant lottery game according to the system of this invention. The lottery number generation is controlled by a digital computer 30 which includes a random number generator or pseudo-randomiser 31 which functions to generate the required set of lottery numbers for use with the instant lottery tickets of the lottery game. These random numbers from the random number generator 31 are seperately stored onto a master disk 32 and a so-called printer data base cassette 33 for use with a plurality of dispensing units, as will be described below. The set of lottery numbers generated by the random number generator 31 is also fed to a random number selector 34 which accepts the set of generated lottery numbers and randomly selects from within this set a given number of lottery numbers which are to be designated as the winning numbers. The number of winning lottery numbers selected by the random number selector 34 is determined by the desired odds of winning. The set of randomly selected winning numbers is seperately stored onto a master disk 32 and a so-called reader data base cassette for use with a plurality of reader units, as will be described below.

In order to permit operation of the lottery game with a plurality of dispensing units, the digital computer can be programmed to assign specific portions of the set of lottery numbers randomly generated by the random number generator 31 to a plurality of cassettes for use with corresponding dispensing units. These randomly assigned portions of the set of lottery numbers are also stored on the master disk 32. The master disk, hence serves as the sole record of information relating to which portion of the set of lottery numbers has been assigned to which particular dispensing unit. Hence even in the unlikely possibility of someone accessing the reader data base to get at a set of winning numbers, there is no way of determining which dispensing unit is capable of dispensing the lottery numbers corresponding to the winning numbers. This arrangement sets up a virtually foolproof level of security about the lottery game as will be described in detail below.

Figure 4:
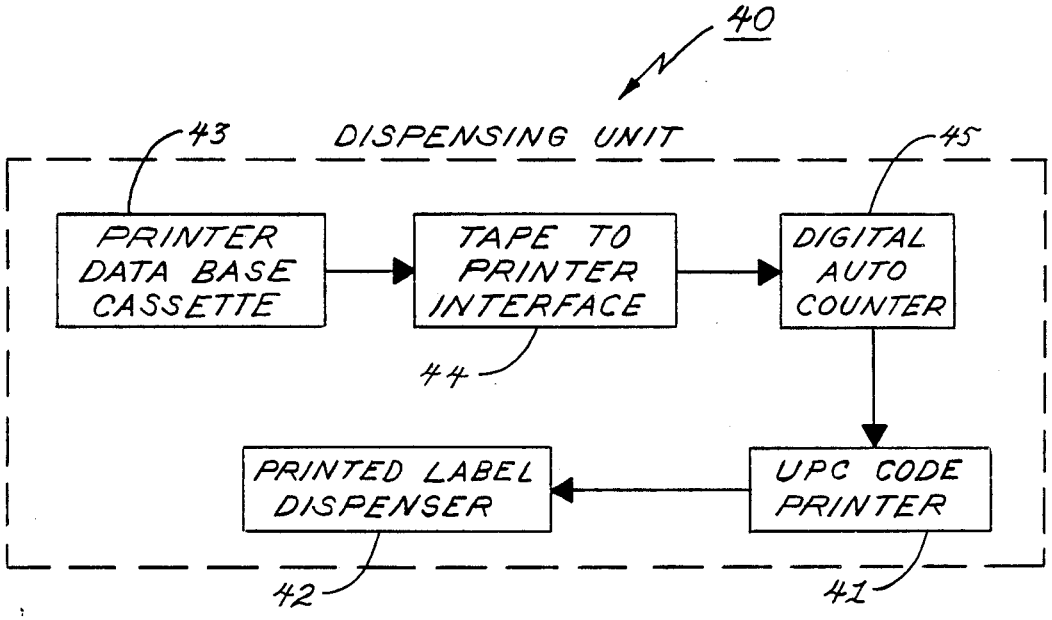
FIG. 4 is a simplified block diagram representation of a dispensing unit according to this invention.

Referring now to FIG. 4, there is shown a simplified block diagram representation of a dispensing unit according to the system of this invention. The dispensing unit essentially comprises a conventional UPC code impact or laser printer 41 associated with a dispenser 42 for the labels printed by the code printer 41. The printer basically functions to printout in bar code form the digital lottery numbers fed to it. The action of the UPC code printer 41 is controlled by the printer data base cassette 43, which has stored within it the particular batch of randomly generated lottery numbers assigned to it by the digital computer, via a conventional digital interface 44 which establishes the proper communication link between the printer data base and the code printer 41. Thus, each time the dispensing unit is activated, the printer data base cassette is accessed and a lottery number is retrieved from the batch of lottery numbers stored within the cassette.

The retrieved lottery number is then fed through the tape-to-printer interface 44 and a digital counter 45 to the UPC code printer 41. The code printer then transposes and prints the accepted lottery number onto the lottery number label in the form of a UPC bar code corresponding to the retrieved lottery number. The retrieval of lottery numbers from within the printer data base cassette is performed in a sequential manner and the digital autocounter 45 serves to keep track of how many lottery numbers have in fact been retrieved at any given time. The counter, in effect, provides a reference pointer to the exact position on the data base cassette from which the lottery number for a preceding printed label was retrieved.

It must be noted that the lottery numbers printed onto the dispensed labels are not in a serial order; instead they are a sequential printing of the randomly generated lottery numbers present in the particular batch assigned to the particular data base cassette being used with a given dispensing unit. Hence, there is no way for an outside source to determine or even guess, from any dispensed printed label, what the lottery number on the succeeding label will be. The dispensing unit also has safeguards built into it which automatically disrupt the communication link between the data base cassette and the UPC code printer in the event of physical tampering or mechanical failure. In case disruption occurs for some reason, the digital autocounter 45 serves as a reference to the last lottery number retrieved from the printer data base cassette 43 so that the dispensing unit, when functioning again, is capable of accessing the printer data base cassette to retrieve lottery numbers immediately succeeding the last lottery number retrieved from the cassette prior to shutoff. This insures that when the dispensing unit restarts the sequential lottery printing process no duplication or omission of lottery numbers stored within the data base cassette of the printer takes place.

Each time a new set of lottery numbers needs to be printed out, the only change needed within the dispensing unit is the replacement of its printer data base cassette 43. Hence, when a new lottery game is to be commissioned, a new set of lottery numbers is randomly generated by the digital computer and batches of lottery numbers from this set are assigned to particular printer data base cassettes, one of which may be used to replace the printer cassette for a given dispensing unit thereby making it capable of printing labels on the basis of the newly generated lottery numbers.

Figure 5:
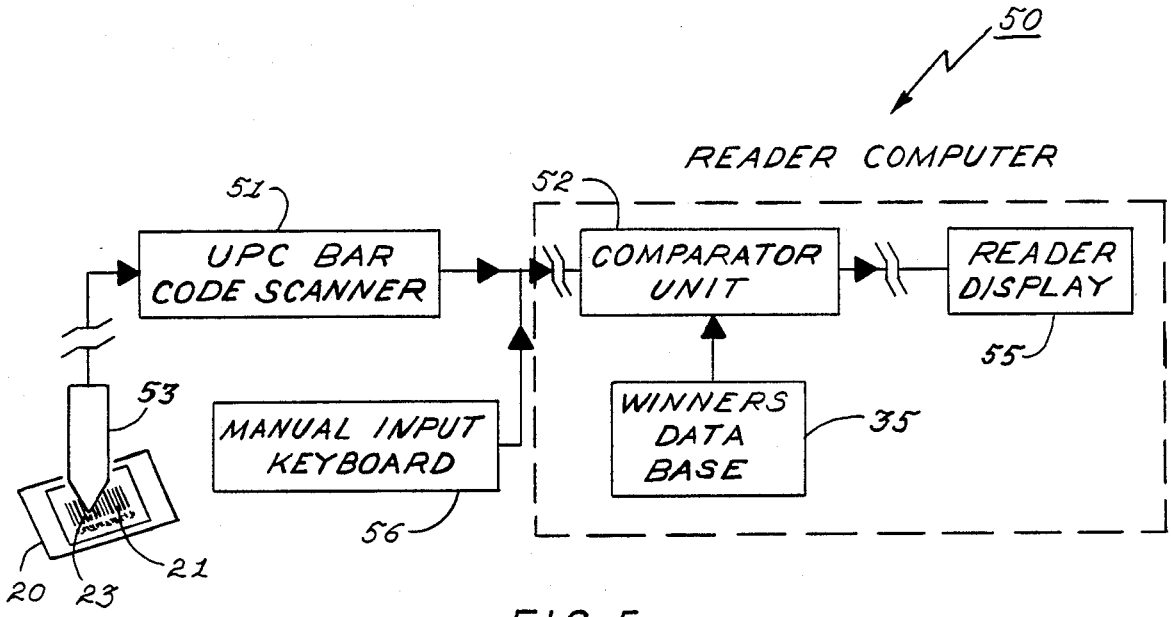
FIG. 5 is a block diagram representation of the reader end for use with instant lottery games according to this invention.

Referring now to FIG. 5, there is shown a simplified block diagram of the lottery ticket reader unit according to the illustrious lottery game system. The reader unit 50 essentially comprises a conventional UPC bar code scanner 51 operating in conjunction with the digital reader computer 52. The code scanner 51 functions to read the bar code 23 printed on the label 21, which has been placed on the instant lottery ticket 20, by use of a code scanner probe 53 and converts the scanned bar code into the lottery number which it represents in digital form. This information is fed to the reader computer 52.

The reader computer, according to this invention, is programmed to recognize all the randomly selected winning numbers defined by the digital computer 30 shown in FIG. 3. More specifically, the data base 35 of winners selected from the set of randomly generated lottery numbers by the random winning number selector 34 is provided to the digital computer 52 of the reader unit 50 and forms a basis for comparing the lottery number scanned in bar code form by the bar code scanner 51. For illustrative purposes only, a comparator unit 52 has been shown and is representative of the comparison functions of the reader computer 52. Each time a lottery ticket is presented for scanning the resultant lottery number generated by the bar code scanner 51 is compared to each of the winning numbers stored within the winner's data base 35. If the scanned lottery number matches any of the winning numbers a visual indication is given on the digital display of the reader unit. A manual input keyboard 56 is also provided with the reader unit 50 so that the lottery numbers representing the printed bar code, if printed on the lottery ticket, may be manually keyed into the reader computer and serves as a redundancy feature for occasions when the bar code scanner or its probe are malfunctioning or not functioning at all.

It will be noted that the reader unit 50 as described above, including the UPC bar code scanner, the manual input keyboard and the reader digital computer is fairly conventional and normally has stored within its data base the UPC bar codes representing the product codes meant to be recognized by the reader computer. Such reader units are normally available at most establishments (i.e., department stores, grocery stores or the like) where the illustrious invention is generally applicable. All that is required in order to adapt such conventional reader units 50 in order to function according to the system of this invention is the provision of the winners data base 35 in addition to the normal data base of the reader computer and some related software changes.

Figure 6:
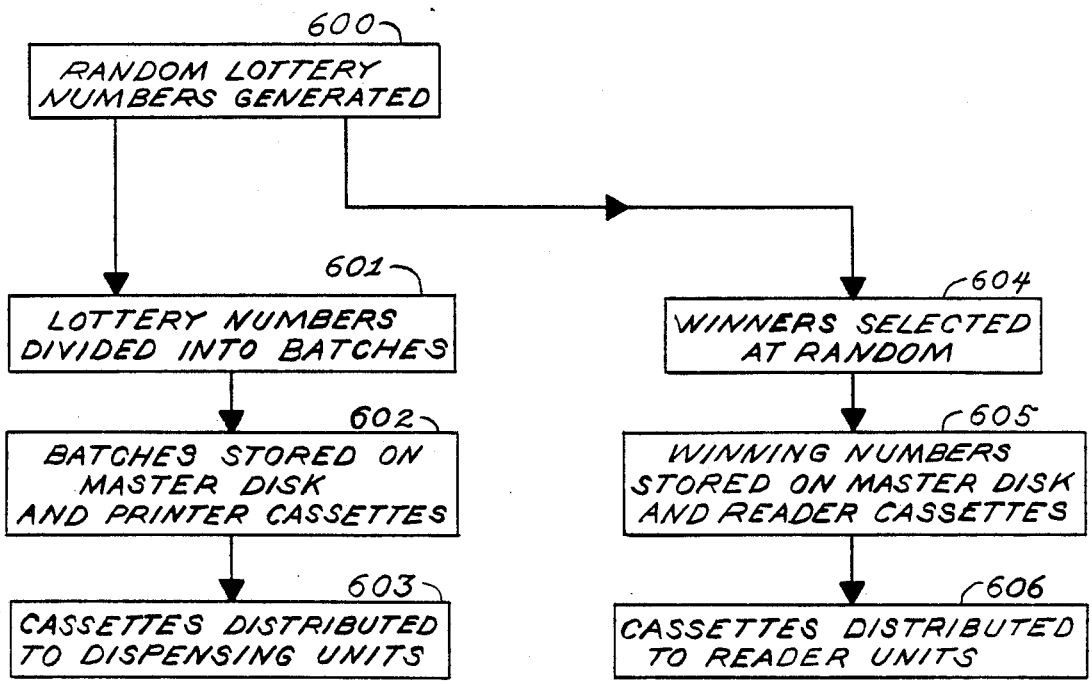
FIG. 6 is a simplified flow diagram of the lottery game playing procedure according to the system of this invention.

FIG. 6 is a simplifed flow diagram representation of the procedure involved in the generation and distribution of lottery numbers as well as the lottery winners. The initial step 600 involves the random generation of the required number of lottery numbers by use of the pseudo-randomizer under the control of the digital computer, as shown in FIG. 3. At the next step 601, the complete set of randomly generated lottery numbers is divided into separate batches of lottery numbers. The number of batches is equivalent to the desired number of dispensing units for use with the instant lottery system. Generally, a single dispensing unit is provided for each establishment taking part in the instant lottery game. These batches of lottery numbers, which in combination form the overall set of lottery numbers generated at step 600, are then stored on individual cassettes as well as on a master disk at step 602.

In the following step 603, the cassettes having the batches of lottery numbers stored on them are distributed to the various dispensing units constituting the lottery system.

Step 604, which may be performed simultaneously along with step 601, involves the random selection of winning lottery numbers from the set of randomly generated lotery numbers defined at step 600. This is the point where the odds of winning may be controlled conveniently. At the following step 605, the randomly selected winning numbers are stored on the master disk on which the complete set of lottery numbers has been stored at step 602. Step 605 also involves the duplication of the set of winning numbers onto a number of cassettes corresponding to the number of reader units included as a part of the lottery game. At step 606 these cassettes, each having a set of winning lottery numbers stored on it, are distributed to the various reader units.

It will be appreciated that in the overall process of generation of the complete set of lottery numbers as well as the selection of winning lottery numbers from therein, human intervention is restricted to the original generation of the master program for the digital computer, which controls the lottery number generation and the selection of winners. Neither the complete set of lottery numbers nor specific winning lottery numbers are directly accessible at any stage. Once the cassettes designated for specific dispensing units and reader units are distributed the only permanent record of the lottery numbers and the selected winners is on the master disk, which may be kept in the safe custody of the lottery game operator.

According to a feature of this invention, the cassette onto which the set of randomly selected winning lottery numbers is stored i.e., the reader cassette may also include a variety of information related to the lottery game. For instance, along with each lottery number there may be associated information defining the particular prize to be awarded for that lottery number. The reader cassette may also have stored on it information that defines the deadlines to the lottery game so that the list of winning lottery numbers remains valid only up to the defined deadline. When the reader cassette is accessed by the reader unit, such information is also retrieved and subsequently acted upon as required.

Figure 7:
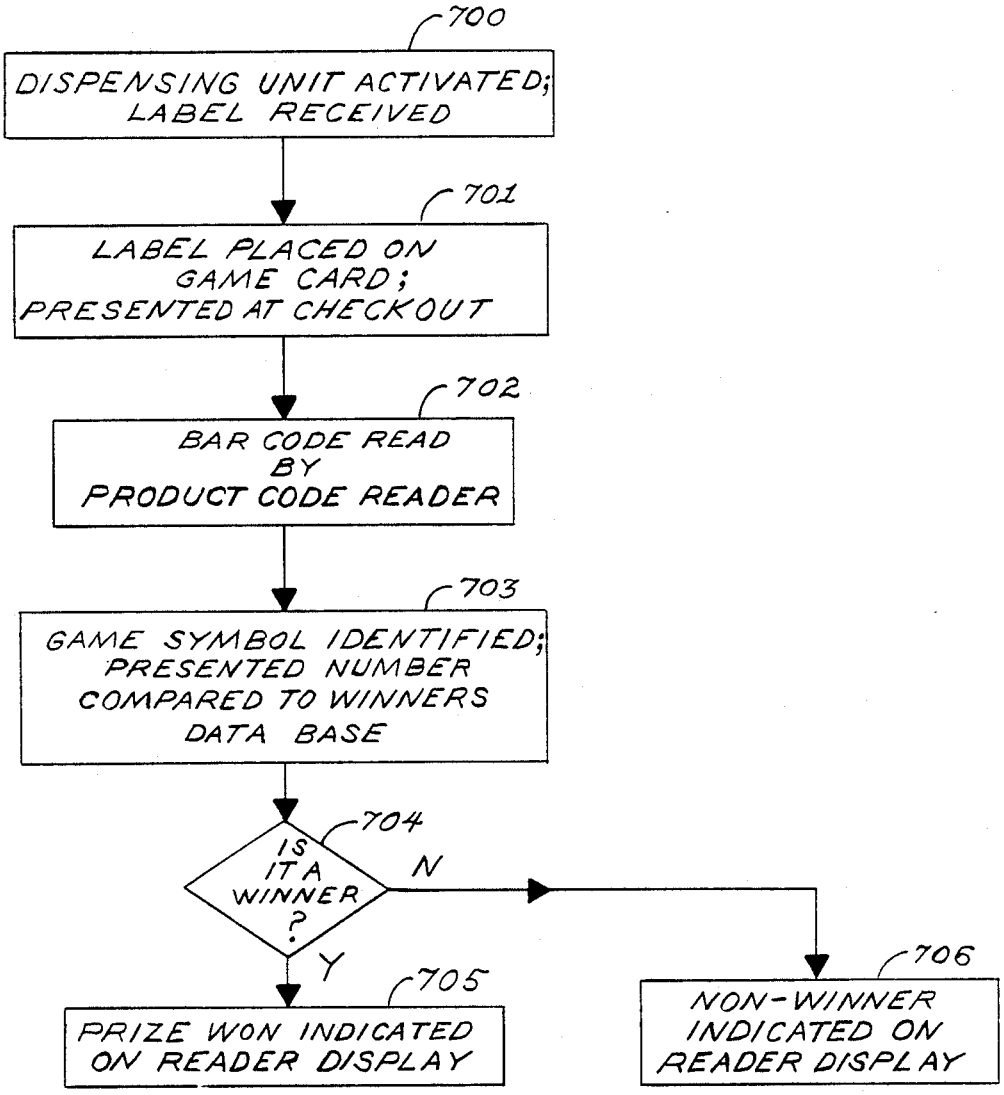
FIG. 7 is a flow diagram of the procedure involved at the user end.

Referring now to FIG. 7, there is shown a simplified flow diagram of the procedure involved at the user end, at one of the participating establishments, in the instant lottery game according to the system of this invention. Before the participant gets involved in this procedure, the participating establishment installs the distributed reader cassette and dispensing unit cassette assigned to it into the reader unit and the dispensing unit, respectively, located at the site of the lottery game.

Subsequently, at step 700, the participant, having picked up a lottery ticket blank, activates the dispensing unit by depositing the specified amount of money representing the price of the ticket into the unit. When the dispensing unit is activated it accesses the unit's data base containing the particular batch of sequentially stored lottery numbers assigned to the dispensing unit, and retrieves the uppermost lottery number, which is then fed via the printer interface to the UPC bar code printer which prints the retrieved lottery number, in its bar code form onto a dispenser label. The printed label is then dispensed out to the participant.

At the next step 701, the participant receives the dispensed label, exposes the pressure sensitive adhesive coating behind the label and places it onto the designated area on the lottery ticket bank. The participant then, at his convenience, presents the lottery ticket at the checkout counter of the participating establishment. In fact, after purchase of the lottery ticket, the participant may proceed with his regular shopping through the department or grocery store as the case may be and submit the lottery ticket along with the rest of his shopped goods at the checkout counter. At the next step 702 the bar code representing the lottery number on the lottery label is scanned by the product code reader at the checkout counter. More specifically, the person at the checkout counter goes through the process of scanning the bar code on the lottery ticket in exactly the same way as he does for the rest of the shopped goods. The reader computer is programmed to recognize the game identification number at the beginning of the UPC code number printed onto the lottery ticket. Once it has identified the UPC code to be related to the lottery game, the computer accesses its data base of winning numbers for the lottery game and compares the accepted lottery number with the list of winning numbers stored within its data base to check for a possible match (Step 704).

If the comparison comes out with a positive match, an indication is given, at step 705, on the digital display of the reader unit showing that the particular lottery ticket scanned is a winner and an indication may also be given of the prize due to the winner. If the comparison does not come up with a positive match, i.e., the presented lottery number does not correspond to any of the numbers on the list of winning numbers provided to the reader unit, an indication is given, at step 706 on the reader display showing that the presented lottery ticket is not a winner. The procedure involved scanning the bar coded lottery number to determine whether a given lottery ticket is a winner or not is extremely convenient because it is identical to the product scanning procedure followed by the participating establishments during the normal course of their business.

As is apparent from the description of the lottery game system according to this invention, close control may be maintained over the operation of the game by virtue of the fact that only simple software changes are required in order to change the controlling parameters of the game. For example, the odds of winning can be controlled or changed at any time during the operation of the lottery game. More specifically, the odds of winning may be increased by modifying the master program so that a larger number of winning lottery numbers are selected randomly from the universal set of randomly generated lottery numbers. This larger set of winning numbers can then be transferred onto the reader data base cassettes which subsequently can be used to replace the original set of winning numbers provided to the reader units. Hence, on days when participating establishments need to attract increased number of customers, as in the case of promotional sales or similar events, they may advertise that on these particular days the odds of winning in the lottery game currently in progress will be increased significantly. Subsequently, new reader cassettes with larger lists of winning numbers generated by the modified master program can be used as the data base of winners for the particular days when the odds of winning need to be increased.

The system of this invention also brings about a significant advantage in situations where unprecedented sale of lottery tickets results in the game operator prematurely running out of stock of lottery tickets. With conventional lottery games, the only option available, short of discontinuing the lottery game, is to reprint a new batch of lottery tickets which is virtually impossible within a practical time frame. According to this invention, such a situation can be conveniently handled by using the master program to generate a new set of lottery numbers as well as a corresponding new set of winning lottery numbers. As already described above, a set of lottery numbers so generated may then be divided into separate batches and transferred onto corresponding printer cassettes which are subsequently positioned into the various dispensing units participating in the lottery game. Similarly, the newly generated list of winning lottery numbers is also transferred onto separate reader cassettes which are then used to replace the reader cassettes existing within the various reader units participating in the lottery game. Hence, for all practical purposes, as far as the participating establishments are concerned, the only changes required in order to accommodate either changed odds of winning or continuing the lottery game beyond the originally foreseen universal set of lottery numbers, is the replacement of existing printer and reader cassettes with the newly supplied printer and reader cassettes, respectively.

Another advantage of the instant lottery game according to the system of this invention is that it dispenses with the need for the computer generated complex relationship between the ticket serial number and the corresponding lottery number for the ticket which is normally used by conventional lottery game systems for verification of authenticity of winning lottery tickets. In the illustrious embodiment there is no need for such a security check because the set of winning numbers is unknown to anybody. In addition, the lottery numbers themselves are virtually unknown until the time they are actually printed by the dispensing unit. The only way that a participant may access the set of winning numbers is to get into the software of the reader digital computer, the chances of which are highly unlikely. Even if someone does manage to obtain a reader data base cassette he has no way of knowing which dispensing unit is actually capable of printing out any of the winning lottery numbers.

Figures 2A, 2B:
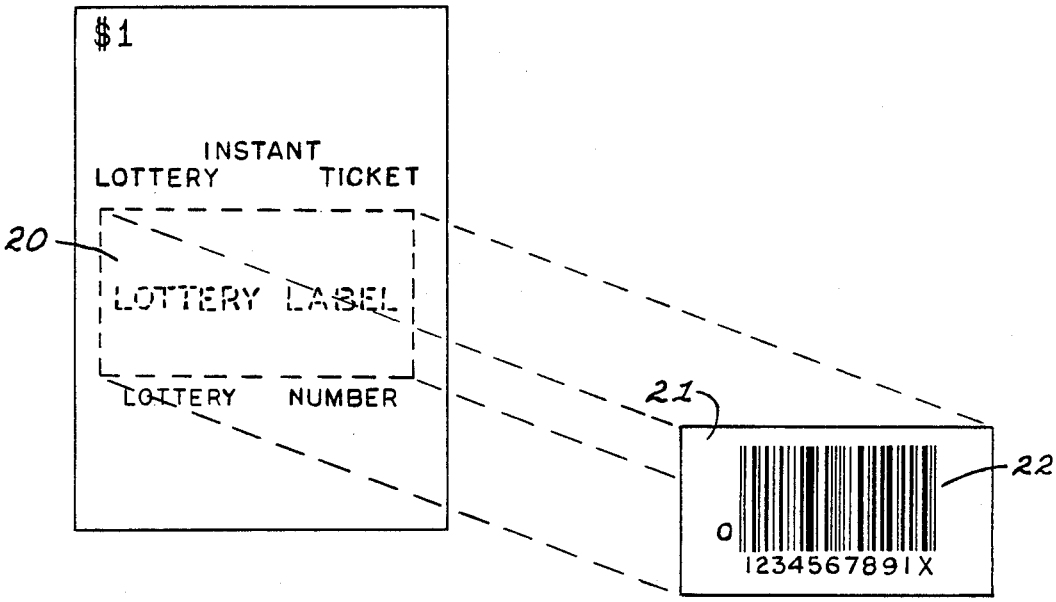
FIG. 2*a* is a frontal view of the face of a lottery ticket according to a preferred embodiment of this invention.
FIG. 2*b* is a plan view of a lottery number label meant for use with the instant lottery ticket of FIG. 2*a;*

The possibility that someone accessing the winning set of numbers may counterfeit a lottery game label with the bar code corresponding to one of the accessed winning lottery number, is further guarded against by the very manner in which the UPC bar code system functions. More specifically, a conventional UPC bar code consists of a 12 digit number 22 (see FIG. 2*b*), of which the first 11 digits are usually printed below the bar code representing those 11 digits. In the more conventional use of bar codes which is the representation of product codes for various products that have been assigned their representative code, the first 11 digits in combination represent the manufacturer code and the product code for a particular product. The 12th digit is generated on the basis of the preceding 11 digits by use of a complex logarithmic algorithm which serves as a cross check to the authenticity of the particular bar code. The 12th digit ('X' in FIGS. 1 and 2*b*) is only represented in its bar code form and is not printed out, as are the preceding 11 digits.

Since, according to this invention, exactly the same procedure is used for generating the transposed UPC bar code corresponding to a given lottery number, the UPC bar code scanner at the reader unit cross checks the logarithmic relationship between the first 11 digits constituting the lottery number and the 12th digit of the lottery number; an accepted scanned lottery number is deemed to be authentic for subsequent comparison with the data base of winners within the reader unit, only if the scanner comes up with a positive check on this logarithmic relationship. Thus, in the highly unlikely event of someone coming into possession of the winning set of lottery numbers, in order to counterfeit a lottery number capable of passing all authentication checks, the person would also have to decipher the complex logarithmic relationship between the first 11 digits and the unprinted 12th digit of the lottery number and then print the lottery number in its corresponding bar code form onto the lottery label. The odds of someone emulating such a counterfeiting procedure border on the impossible and the system of this invention provides a virtually unpentratable level of security against fraudulent misuse.

It will, however, be understood by those skilled in the art that, if needed, the master program may be controlled in such a way that for each randomly generated lottery number a corresponding serial number is also generated in such a way that a complex yet seemingly random correlation exists between the serial number and the corresponding lottery number. The serial numbers may also be transferred along with the corresponding lottery numbers onto the data base for the dispensing unit and the printer controlled so as to print out the corresponding serial number each time a lottery number is printed onto the lottery label. At the reader end, the digital computer can then be programmed in such a way that each time a scanned number is presented to it, it tests the correlation with the associated serial number so that improperly altered or counterfeit lottery numbers may be detected.

It will be understood that the invention is not limited to the use of the 12 digit UPC bar code as described in the illustrious embodiment; the compressed form of the UPC bar code wherein a reduced number of digits is utilized may also be used just as conveniently. Other types of bar codes may be used for the representation of the lottery numbers as long as the reader end has a corresponding bar code scanner capable of transposing the bar codes into the corresponding lottery numbers they represent in digital form.

An important modification of the system of this invention is the printing of the bar codes representing the lottery numbers directly onto product labels, whereby the lottery number bar code may be scanned immediately after the conventional product bar code normally printed on the product label. Such a system would be especially applicable to product promotion campaigns wherein the customer may be offered a free chance to participate in the lottery game if he buys a particular product. In such cases, the person using the bar code scanner probe first scans the UPC product bar code printed on the product label and then scans the succeeding lottery number also printed in bar code form behind the conventional product bar code. The digital computer of the reader units is programmed to accept the scanned lottery number only if the preceding bar code matches up with a list of valid product codes stored within its data base. This insures that the lottery numbers remain valid only with the purchase of the specified products. In these cases, the prizes awarded to winning lottery numbers may be of monetary value as in conventional instant lottery games or the reader unit may be programmed in such a way that a discounted price on the purchase product is automatically offered if the scanned lottery number is found to be a winner.

It will be understood by those skilled in the art that such an implementation and modification of the system of the present invention basically requires software changes only at the lottery number generator end as well as the reader end. More specifically, in this situation the generation of lottery number and the random selection of winning lottery numbers by using the digital computer stays the same as described with respect to FIG. 3. However, in addition to storing the list of winning lottery numbers onto the reader data base cassette, a list of valid product codes corresponding to the products designated for the promotional campaign is also stored onto the reader cassette before duplicating it for distribution to the various reader units at the establishments participating in the particular promotional campaign.

At the reader end, when a participating customer presents a product for purchase at the checkout counter, the UPC product code as well as the lottery number product code printed on the product label are scanned, and the digital computer of the reader unit then compares the scanned product code with the list of valid product codes stored within the reader cassette. The lottery number scanned after the product code is accepted only if the scanned product code is found to match one of the valid product codes on the list. Once the scanned lottery number has been accepted the reader computer then accesses the list of winning lottery numbers also stored on the reader data base cassette and performs a comparison to see if the scanned lottery number matches one of the winning lottery numbers and, as described above, provides external indication of the results of the comparison.

The illustrious instant lottery game system also eliminates the need for elaborate printing procedures for the lottery tickets. The ticket blanks can be printed in advance, in large quantities and, if needed, in various formats using conventional printing procedures. The lottery labels needed to make the tickets valid are printed instantaneously at the site of the game, but there is no need for complex techniques to conceal the lottery number printed in bar code form on the label. Any desired increase in the number of valid lottery tickets for the game can be accommodated easily, since the extra number of ticket blanks as well as lottery labels are readily available and, as described above, only software changes are needed to expand the overall set of lottery numbers.

The lottery game system, according to this invention, thus provides a flexible instant lottery game system which is easy and convenient to operate and control, which provides reasonable control over game variables including the odds of winning, which also provides a significantly higher level of security against fraud and misuse and, as described above, which may be conveniently adapted for use with existing hardware at participating establishments.

I claim:

1. A method of playing an instant lottery game having a beginning time of play comprising the steps of:

generating a set of lottery numbers;

relating a master list containing said set of random lottery numbers;

representing said set of lottery numbers on a plurality of lottery tickets in a UPC bar code form selecting one or more sub-sets of said lottery numbers from said master list coincident with said beginning the time of play of said instant lottery game, each sub-set corresponding to a different winning value;

distributing said plurality of lottery tickets to a plurality of participants for presentation at one or more designated locations; and providing said one or more sub-sets of said lottery numbers o said designated locations for comparing each of said presented lottery tickets at the designated locations to said one or more sub-sets of winning numbers to determine whether each of said presented lottery tickets represents a winning lottery number.

2. The method of claim 1 wherein said generating is done randomly.

3. The method of claim 1 wherein said bar codes for said lottery numbers are printed directly on said lottery tickets.

4. The method of claim 1 wherein said bar codes for said lottery numbers are printed on separate lottery labels adapted to be positioned on said lottery tickets.

5. The method of claim 1 wherein said lottery tickets are commercial product labels.

6. The method of claim 1 wherein said lottery tickets are commercial coupons.

7. An instant lottery game system having a beginning time of play comprising:

a first means for generating and relating a set of lottery numbers;

a second means for generating winning lottery numbers from said set of randomly generated lottery numbers coincident with said beginning time of play of said instant lottery game;

a plurality of lottery tickets, each having one of said lottery numbers represented on it in the form of a UPC bar code, and a third means for providing said winning lottery numbers to one or more designated locations where said UPC bar code may be read and compared to said winning numbers.

8. The instant lottery game system of claim 7 wherein said bar code for said lottery numbers is printed directly on said lottery tickets.

9. The instant lottery game system of claim 7 wherein said bar codes for said lottery numbers are printed on separate lottery labels adapted to be positioned on said lottery tickets.

10. The instant lottery game system of claim 7 wherein said lottery tickets are commercial product labels.

11. The instant lottery game system of claim 7 wherein said lottery tickets are commercial coupons.

* * * * *

UNITED STATES PATENT AND TRADEMARK OFFICE

CERTIFICATE OF CORRECTION

PATENT NO. : 4,832,341

DATED : May 23, 1989

INVENTOR(S) : Richard W. Muller and Kenneth R. Rusnak

It is certified that error appears in the above-identified patent and that said Letters Patent is hereby corrected as shown below:

At column 13, line 47, delete the word "relating" and insert the word -- retaining --;

At column 13, line 50, immediately after the word "form", insert the symbol -- ; --;

At column 14, line 1, delete first word in the line which is "the";

At column 14, line 7, after the word "numbers" delete the character "o" and insert the word -- to --;

At colume 14, line 27, delete the word "relating" and insert the word -- retaining --.

Signed and Sealed this

Sixth Day of March, 1990

*Attest:*

JEFFREY M. SAMUELS

*Attesting Officer*

*Acting Commissioner of Patents and Trademarks*